US010301549B2

(12) United States Patent
Kennel et al.

(10) Patent No.: US 10,301,549 B2
(45) Date of Patent: May 28, 2019

(54) PROCESS FOR DEPOLYMERIZING COAL TO CO-PRODUCE PITCH AND NAPHTHALENE

(71) Applicant: Quantex Research Corporation, Kitchener (CA)

(72) Inventors: Elliot B. Kennel, Beavercreek, OH (US); Gilbert A. Chalifoux, Mississauga (CA)

(73) Assignee: QUANTEX RESEARCH CORPORATION, Kitchener, Ontario (CA)

( * ) Notice: Subject to any disclaimer, the term of this patent is extended or adjusted under 35 U.S.C. 154(b) by 2 days.

(21) Appl. No.: 15/812,312

(22) Filed: Nov. 14, 2017

(65) Prior Publication Data

US 2018/0112135 A1 Apr. 26, 2018

Related U.S. Application Data

(63) Continuation of application No. 15/358,820, filed on Nov. 22, 2016, now Pat. No. 9,845,431, which is a (Continued)

(51) Int. Cl.
*C10G 1/06* (2006.01)
*C10G 1/00* (2006.01)
(Continued)

(52) U.S. Cl.
CPC ..... *C10G 1/065* (2013.01); *C10B 55/00* (2013.01); *C10G 1/002* (2013.01); *C10G 1/02* (2013.01)

(58) Field of Classification Search
CPC ..... C10G 1/065; C10G 1/02; C10G 1/002; C10B 55/00
See application file for complete search history.

(56) References Cited

U.S. PATENT DOCUMENTS 3,503,864 A 3/1970 Nelson
4,022,680 A 5/1977 Maa
(Continued)

FOREIGN PATENT DOCUMENTS

JP 8231443 A 9/1996
JP 2874777 B2 3/1999

OTHER PUBLICATIONS

Coal Characteristics, Purdue University 2008 (Year: 2008).*
(Continued)

*Primary Examiner* — Randy Boyer
*Assistant Examiner* — Juan C Valencia
(74) *Attorney, Agent, or Firm* — The Webb Law Firm

(57) ABSTRACT

A method of depolymerizing coal includes preparing a high temperature depolymerizing medium consisting of heavy hydrocarbon oils and mixing it with coal to form a mixture, performing an optional first distillation at a temperature below 250° C. to recover naphthalene, heating the mixture to a temperature between 350° C. and 450° C. to create a digested coal, centrifuging the digested coal to remove ash and obtain a centrate, and distillation of the centrate into separate fractions. The high temperature depolymerizing medium may be a heavy hydrocarbon with a hydrogen to carbon (H/C) ratio higher than 7.0% and may include liquids chosen from the group consisting of: coal tar distillate, decant oil, anthracene oil, and heavy aromatic oils. The high temperature depolymerizing medium may be blended with an oil, preferably with H/C ratio higher than 10.0%, such as soybean oil, other biomass derived oil, lignin, petroleum oil, pyrolysis oil such that the overall hydrogen-to-carbon mass ratio in a digestion reactor is over 7.0% for the mixture of depolymerizing medium and coal. The depolymerized coal is an aromatic liquid that can itself be, either wholly or in
(Continued)

part, a depolymerizing medium so that the process can be repeated.

19 Claims, 3 Drawing Sheets

Related U.S. Application Data continuation of application No. 14/966,262, filed on Dec. 11, 2015, now Pat. No. 9,534,176.

(60) Provisional application No. 62/090,952, filed on Dec. 12, 2014.

(51) Int. Cl.
*C10G 1/02* (2006.01)
*C10B 55/00* (2006.01)

(56) References Cited

U.S. PATENT DOCUMENTS 4,077,867 A 3/1978 Aldridge et al.
4,085,032 A 4/1978 Aczel et al.
4,085,033 A 4/1978 Plumlee
4,098,838 A 7/1978 Grigoleit et al.
T989,001 I4 12/1979 Gorin
4,347,116 A * 8/1982 Whitehurst ..... C10G 1/002 208/416
4,347,117 A 8/1982 Bauman et al.
4,363,716 A 12/1982 Greene et al.
4,439,309 A 3/1984 Greene et al.
4,663,028 A 5/1987 Ditman
5,151,159 A 9/1992 Wolfe et al.
5,296,005 A 3/1994 Wolfe et al.
7,594,990 B2 9/2009 Satchell, Jr.
8,226,816 B2 7/2012 Kennel et al.
8,423,976 B2 4/2013 Zwimer et al.
8,465,561 B2 6/2013 Stiller et al.
8,597,503 B2 12/2013 Stiller et al.
2008/0072476 A1 3/2008 Kennel et al.
2012/0080358 A1 4/2012 Stiller et al.
2012/0091042 A1* 4/2012 Stiller ..... C10G 1/002 208/435

OTHER PUBLICATIONS

Gosselink, "Lignin as a Renewable Aromatic Resource for the Chemical Industry," Dec. 7, 2011, pp. 1-195, Wageningen University.

He et al., "Methylation of Naphthalene by Methane over Substituted Aluminophosphate Molecular Sieves," Energy & Fuels, 1992, pp. 498-502, vol. 6, No. 4.

Kennel et al., "Enhanced Hydrogen Economics via Co-Production of Fuels and Carbon Products," U.S. Department of Energy Report DE-FC26-06NT42761, 2011, pp. 1-361.

Onwudili et al., "Reaction mechanisms for the decomposition of phenanthrene and naphthalene under hydrothermal conditions," The Journal of Supercritical Fluids, Jan. 2007, pp. 399-408, vol. 39, No. 3.

Schabron et al., "Correlation Between Carbon Residue and Molecular Weight," 386-389, Western Research Institute.

* cited by examiner

Figure 1. Simulated Distillation of Post reaction Distillate and Depolymerized Bituminous Coal (after), based upon data from Table 1.

Figure 2. Simulated Distillation of Coal Tar Distillate based upon data acquired by Gas Chromatograph. The same data is also compiled in Table 1.

PROCESS FOR DEPOLYMERIZING COAL TO CO-PRODUCE PITCH AND NAPHTHALENE

CROSS REFERENCE TO RELATED APPLICATIONS

This application is a continuation of U.S. patent application Ser. No. 15/358,820, filed Nov. 22, 2016, which is a continuation of Ser. No. 14/966,262, filed Dec. 11, 2015, now U.S. Pat. No. 9,534,176, which claims priority to U.S. Provisional Application No. 62/090,952, filed Dec. 12, 2014, each of which is hereby incorporated by reference in its entirety.

BACKGROUND OF THE INVENTION

Field of the Invention

This application relates to the processing of coal and blended coal depolymerizing medium to depolymerize coal and create heavy products, such as binder pitch and pitch coke, as well as a liquid oil comprised of chemical constituents such as naphthalene having an atmospheric pressure boiling point of 270° C. or lower. Liquefaction occurs substantially by depolymerizing the coal and preventing repolymerization processes.

Description of the Related Art

Naphthalene, a valuable chemical feedstock, is difficult to recover from a coal digest. This is evidenced by the data summarized in FIG. 1, FIG. 2, and Table 1. The data show that the naphthalene does not absorb hydrogen to become tetrahydronaphthalene because there is no discernable tetrahydronaphthalene in the post-reaction assay. Hence most of naphthalene must have decomposed. Hence decomposition is proven to be the favored reaction pathway, not hydrogen absorption, at least in this instance.

This is evident from examining FIG. 1, which is a simulated distillation (SIMDIST) curve from coal tar distillate, showing some 12.26% naphthalene content by mass of solvent with boiling point of 218° C. Yet, after depolymerizing bituminous coal in a ratio of two parts coal tar distillate to one part coal, as shown in FIG. 2, the percentage of naphthalene being distilled at the same temperature of 218° C. decreases to 3.82%. Table 1 memorializes the data illustrated in FIG. 1 and FIG. 2, where the data in the columns indicates the Wt % (content by mass) of each listed item that is simulated or measured at each of their respective boiling points, and the leftmost column is for coal tar distillate without coal and the rightmost column is for post reaction distillate and depolymerized bituminous coal. Evidently, the digestion reaction evaporated or destroyed the naphthalene, probably resulting in generation of low molecular weight methane and possibly carbon dioxide, which are considered to be less valuable than naphthalene. Moreover, the generation of gas creates a pressure rise in the reactor, requiring a higher pressure rating of the reactor. Based on a 2:1 ratio of liquid solvent to coal, the mass of naphthalene in the solvent alone is equal to the mass of about 24% of the amount of coal in the input feed. Additional naphthalene is also present in bituminous coal. This suggests that the total loss of naphthalene from coal and coal tar distillate is substantial and cannot be accounted for via hydrogen absorption reactions.

Naphthalene is a useful feedstock for creating fuels including gasoline, diesel, jet fuel and others. Naphthalene may be reacted to form fuel constituents such as methyl naphthalene, tetralin (tetrahydronaphthalene) or decalin (decahydronaphthalene). Hence, an object of the present disclosure is to avoid decomposition of naphthalene in a depolymerization reaction. This is accomplished in the present disclosure by partially distilling the input feedstock blend (i.e., depolymerization medium and coal). In this case, the cut point, or temperature at which distillation is to be terminated, should be about 220° C. to 260° C. at atmospheric pressure; i.e., higher than the boiling point of naphthalene. Lower temperature distillation is possible at lower pressure. This distillation step results in the recovery of most of the naphthalene in the blend of digestion medium. Given that naphthalene ($C_{10}H_8$) has a hydrogen content of 6.25%, it should be replaced by the addition of additional liquid with equivalent or higher hydrogen content in order to maintain fluidity and depolymerization capability.

TABLE 1

Gas Chromatograph, Coal (Lower Kittanning/Kingwood), Soybean Oil and Coal Tar Distillate.

| Boiling Pt | | Coal Tar Distillate Only Wt. % | Post reaction Distillate and Depolymerized Bituminous Coal (after) Wt. % |
|---|---|---|---|
| | Benzene | 0 | 0 |
| 110.6 | toluene | 0.17 | 0.05 |
| 120 | unided | 0.63 | 0 |
| 136 | ethylbenzene | 0.27 | 0 |
| 139 | m + p xylene | 0 | 0 |
| 145 | styrene | 0 | 0 |
| 145 | o xylene | 0.65 | 0.1 |
| 161 | 3 + 4 ethyl toluene | 0.5 | 0 |
| 165 | 1,3,5 trimethyl benzene | 0 | 0 |
| | benzonitrile | 0 | 0 |
| | phenol | 0 | 0 |
| 168 | 1,2,4 trimethyl benzene | 0 | 0 |
| | 2,3 benzofuran | 0 | 0 |
| | 1,2,3 trimethyl benzene | 0 | 0 |
| | indan | 0.39 | 0.115 |
| 177 | indene | 0.16 | 0.195 |
| 180 | | 0 | 0 |
| 190 | o cresol | 0.18 | 0 |
| 201 | m + p cresol | 0.47 | 0 |
| | non-id | 0 | 0 |
| 212 | 2,4 dimethyl phenol | 0.19 | 0 |
| 218 | Naphthalene | 12.26 | 3.82 |
| 221 | benzothiophene | 0.33 | 0 |
| | quinoline | 0 | 0 |
| 242 | isoquinoline | 0 | 0 |
| | methyl benzothiophene | 0.37 | 0 |
| | 2methyl naphthalene | 1.62 | 0.66 |
| | methyl benzothiophene | 0.37 | 0 |
| | 1methyl naphthalene | 0.88 | 0.39 |
| | | 0.46 | 0.175 |
| 256 | Biphenyl | 0.46 | 0.255 |
| | | 1.09 | 0.415 |
| 270 | Acenaphthylene | 4.01 | 4.24 |
| | Acenaphthene | 2.28 | 0.525 |
| | | 0.36 | 0.11 |
| 287 | Dibenzofuran | 2.2 | 2.04 |
| | | 0 | 0.375 |
| 295 | Fluorene | 3.13 | 3.35 |
| | | 1.92 | 7.575 |
| 332 | dibenzothiophene | 0.44 | 2.44 |
| | | 5.5 | 2.08 |
| | Phenanthrene | 17.95 | 23.805 |
| 340 | Anthracene | 1.87 | 1.935 |
| | | 0.45 | 1.42 |
| | carbazole | 0.92 | 1.17 |
| | | 13.56 | 15.04 |

TABLE 1-continued

Gas Chromatograph, Coal (Lower Kittanning/Kingwood), Soybean Oil and Coal Tar Distillate.

| Boiling Pt | | Coal Tar Distillate Only Wt. % | Post reaction Distillate and Depolymerized Bituminous Coal (after) Wt. % |
|---|---|---|---|
| 375 | Fluoranthene | 9.78 | 13.495 |
| | | 0.88 | 0.745 |
| 404 | Pyrene | 7.36 | 9.865 |
| | | 0 | 1.735 |
| 398 | benzo(a)fluorene | 1.27 | 0.74 |
| 399 | benzo(b)fluorene | 1.15 | 0.895 |
| | | 2.23 | 0.135 |
| 425 | Benz(a)anthracene | 0.24 | 0.11 |
| 431 | Chrysene | 1.05 | 0 |
| | triphenylene | 0 | 0 |
| 480 | Benzo(b)fluoranthene | 0 | 0 |
| | Benzo(j)fluoranthene | 0 | 0 |
| | Benzo(k)fluoranthene | 0 | 0 |
| >480° C. | | 0 | 0 |
| | | 100 | 100 |

Therefore, a need exists for co-producing net liquid products following distillation of ash-free coal liquids created by depolymerization and extraction, and in particular avoiding loss of valuable naphthalene in the process.

SUMMARY OF THE INVENTION

One process for producing liquid hydrocarbon products from coal is based on direct liquefaction. Coal is depolymerized in a high temperature aromatic depolymerzing medium. A preferred depolymerizing medium is coal tar distillate or decant oil or recovered depolymerizing media from previous runs. If low ash is required, mineral matter may be removed via centrifugation. The coal may be reconstituted via distillation, resulting in a pitch. If destructively distilled to some 500° C. or above, the pitch may be at least 98% devolatilized and may be further heated and thus converted to a solid coke or char. The aromatic nature of the depolymerizing medium provides that the resultant solid contains anisotropic carbon and thus is a strong coke rather than an amorphous char.

In an aspect, a method of depolymerizing coal may include preparing a high temperature depolymerizing medium consisting of heavy hydrocarbon oils and mixing it with coal to form a mixture, performing a first distillation at a temperature below 250° C. to recover naphthalene, heating the mixture to a temperature between 350° C. and 450° C. for a period of at least one minute to create a digested coal slurry, optionally centrifuging the slurry to produce a centrate liquid with ash content less than 0.2% by mass, and optionally distilling the centrate liquid to produce a pitch residue with hydrogen content between 4.0% and 5.0%, and optimally with a softening temperature of about 110° C. The high temperature depolymerizing medium may be a heavy hydrocarbon with H/C ratio higher than 7.0%. The high temperature depolymerizing medium may consist of liquids chosen from the group consisting of: coal tar distillate, decant oil, anthracene oil, and heavy aromatic oils. The high temperature depolymerizing medium may be blended with an oil, preferably with H/C ratio higher than 10.0%, such as soybean oil, an oil created from vegetable matter with a hydrogen content exceeding 7%, other biomass derived oil, lignin, petroleum oil, pyrolysis oil such that the overall hydrogen-to-carbon mass ratio in a digestion reactor is over 7.0% for the mixture of depolymerizing medium and coal. The coal may be chosen from the group consisting of bituminous, sub-bituminous or lignite coals, preferably having H/C ratio of 7.0% or higher, volatile content of 28% or higher, and ash content less than 10.0%. The coal may be dried via air drying or heating to above 100° C. The coal may be heated in a water-insoluble liquid to above 100° C. The depolymerizing medium may be optionally heated to about 250° C. in order to devolatilize liquids, especially naphthalene, which are condensed in a vessel at lower temperature to obtain devolatilized liquids. The devolatilized liquids optionally may be exposed to methane at pressures above 1000 psig and temperatures above 400° C., to increase the content of methylnaphthalene. The devolatized liquids optionally may be exposed to hydrogen at pressures above 2500 psig and temperatures above 350° C. in the presence of a hydrogenation catalyst containing nickel, iron molybdenum or combinations of these metals, in order to increase the absorption of hydrogen and thus the concentration of tetralin. A mixture of 1 part coal and at least 2 parts depolymerizing medium may be loaded into a pressurized vessel at a pressure between 200 psig and 1500 psig and a temperature of about 380° C. to 420° C., depending on the vapor pressure of the contents, with a preferred operating point of 700 psig and 400° C. Centrifuging may be used to remove ash in solid form from said coal digest, preferably at a temperature of at least 100° C., or above the softening temperature of the liquid constituents of the coal digest. The coal may be a low rank non-coking coal with ash below 5% by mass, wherein the low rank non-coking coal is used to produce a pitch by virtue of having exchanged molecules with the aromatic depolymerizing medium. The pitch may be converted to coke in an oxygen-depleted environment at above 600° C. The coke may be selected from the group consisting of: a metallurgical grade coke, a foundry grade coke, feedstock for other furnace grade carbon such as injection carbon, charge carbon or recarburizer carbon. The coal may be selected such that it has up to 6.0% ash, resulting in a pitch with a comparable ash content. The pitch may be converted to a coke, resulting in a coke with ash content of roughly two times the level of ash in said pitch, especially suitable for a metallurgical grade coke or a foundry grade coke or feedstock for other furnace grade carbon such as injection carbon, charge carbon or recarburizer carbon. The method may further include distilling the centrate liquid to further separate it into different fractions according to boiling point.

The depolymerizing medium may have an H/C ratio of less than 0.70, and the coal may be selected such that its H/C ratio is greater than 0.75, thus resulting in an overall digest with H/C ratio greater than 0.70 on an ash-free basis. The bio-oil may not be present, and hydrogenation may not be used to enhance the hydrogen content of the depolymerizing medium.

Depolymerizing medium may be omitted, and the coal may be selected to have an H/C ratio greater than 0.75, and optimally greater than 0.80, and ash level below 12% by mass, such that the coal can become sufficiently fluid to be centrifuged or filtered directly at a temperature of at least 100° C.

In an aspect, a method of depolymerizing coal may include selecting a coal such that its H/C ratio is greater than 0.72, and optimally greater than 0.80, and ash level below 12% by mass, such that the coal can become sufficiently fluid to be centrifuged or filtered directly at a temperature of at least 100° C., performing a first distillation at a temperature below 250° C. to recover naphthalene, heating the mixture to a temperature between 350° C. and 450° C. for a period of at least one minute to create a digested coal slurry, optionally centrifuging the slurry to produce a centrate liquid with ash content less than 0.2% by mass, and optionally distilling the centrate liquid to produce a pitch residue with hydrogen content between 4.0% and 5.0%, and optimally with a softening temperature of about 110° C.

In an aspect, a method of depolymerizing coal may include preparing a high temperature depolymerizing medium consisting of heavy hydrocarbon oils and mixing it with coal to form a mixture, performing a first distillation at a temperature below 250° C. equivalent atmospheric pressure to recover naphthalene, heating the mixture to a temperature between 350° C. and 450° C. for a period of at least one minute to create a digested coal slurry, optionally centrifuging the slurry to produce a centrate liquid with ash content less than 0.5% by mass, and optionally distilling the centrate liquid to produce a pitch residue with hydrogen content between 4.0% and 5.0%, and optimally with a softening temperature of about 110° C. and ash level less than 0.5% by mass. High temperature depolymerizing medium may be a heavy hydrocarbon with H/C ratio higher than 7.0%. The high temperature depolymerizing medium may consist of liquids chosen from the group consisting of: coal tar distillate, decant oil, anthracene oil, and heavy aromatic oils. The high temperature depolymerizing medium may be blended with an oil, preferably with H/C ratio higher than 10.0%, chosen from the group consisting of: soybean oil, pine tar, aromatic petroleum distillate, biomass gasification tar, biomass pyrolysis tar, and oils where the overall hydrogen-to-carbon mass ratio in a digestion reactor is over 7.0% for the mixture of high temperature depolymerizing medium and coal. The coal may be chosen from the group consisting of bituminous coal, sub-bituminous coal and lignite coal. The coal may have an H/C ratio of 7.0% or higher, volatile content of 28% or higher, and ash content less than 10.0%. The coal may be dried via air drying or heating to above 100° C. prior to exposing the coal to the depolymerizing medium. The coal may be heated in a water-insoluble liquid to above 100° C. The water-insoluble liquid may be the high temperature polymerizing medium. The centrate, either wholly or after being separated into different fractions, may be used as the depolymerizing medium in subsequent executions of the method. The mixture may include a ratio of 1 part coal to a range of at least 1.5 parts to 2.5 parts of depolymerizing medium. The mixture may be loaded into a pressurized vessel at a temperature of not less than 380° C. and not more than 420° C. and an operating pressure between about 200 psig and 1500 psig. The mixture may be loaded into a pressurized vessel at a pressure of about 400 psig and temperature of about 400° C. Centrifuging may be done at a temperature of at least 100° C., or above the softening temperature of the liquid constituents of the coal digest. The coal may be a low rank non-coking coal with ash below 5% by mass, wherein the low rank non-coking coal is used to produce a pitch by virtue of having exchanged molecules with the aromatic depolymerizing medium. The pitch may be converted to a solid carbon coke, in an oxygen-depleted environment at above 600° C., and also co-produces thermally liberated volatile molecules. The coal may be selected such that it has less than 6.0% ash. The method may further include distilling the centrate liquid to further separate it into different fractions according to boiling point. The solid carbon coke may be selected from the group consisting of: a metallurgical grade coke, a foundry grade coke, feedstock for other furnace grade carbon such as injection carbon, charge carbon or recarburizer carbon. The depolymerizing medium may have an H/C ratio of less than 0.70, and the coal is selected such that its H/C ratio is greater than 0.75, thus resulting in an overall digest with H/C ratio greater than 0.70 on an ash-free basis. A bio-oil may not be present, and hydrogenation may not be used to enhance the hydrogen content of the depolymerizing medium. The method may further include filtering the slurry to produce a centrate liquid with ash content less than 0.5% by mass. The ash content may be less than 0.2% by mass. The high temperature depolymerizing medium may be blended with an oil selected from the group consisting of: a biomass-derived oil, a lignin, a petroleum oil, a pyrolysis oil, and an oil from vegetable matter. When the optional centrifugation step is skipped, an ash containing medium suitable for conversion to a solid carbon containing not more than 12% ash content is produced.

These and other systems, methods, objects, features, and advantages of the present disclosure will be apparent to those skilled in the art from the following detailed description of the preferred embodiment and the drawings.

All documents mentioned herein are hereby incorporated in their entirety by reference. References to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context.

BRIEF DESCRIPTION OF THE DRAWINGS

The disclosure and the following detailed description of certain embodiments thereof may be understood by reference to the following figures.

DETAILED DESCRIPTION OF THE INVENTION

Figure 1:
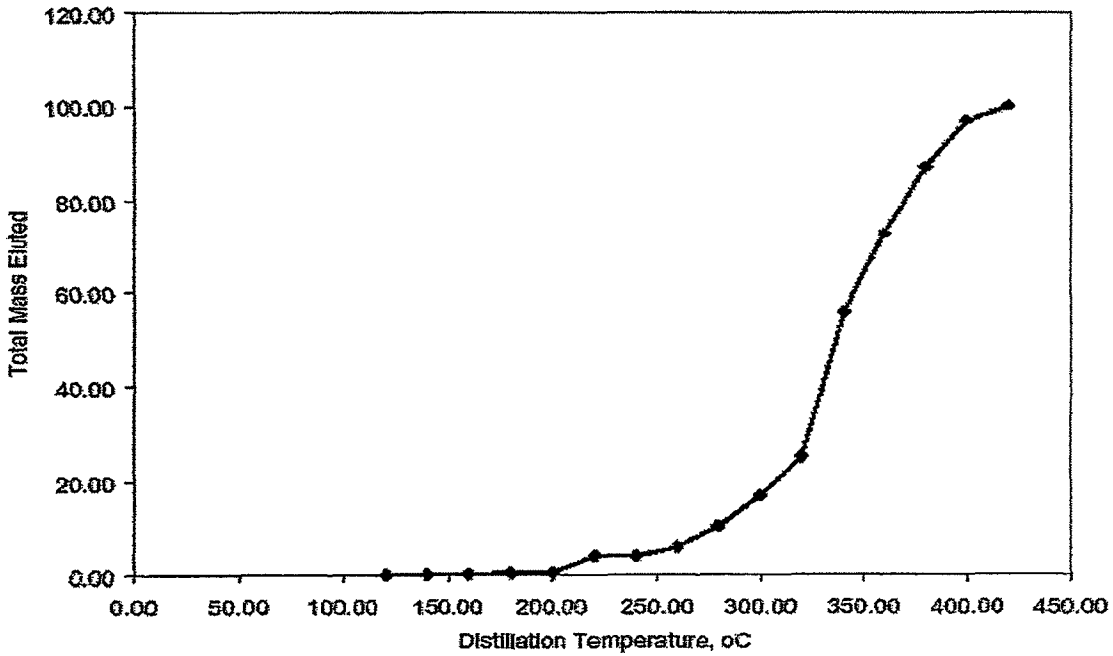
FIG. 1 illustrates a simulated distillation of Post reaction Distillate and Depolymerized Bituminous Coal (after).
Figure 2:
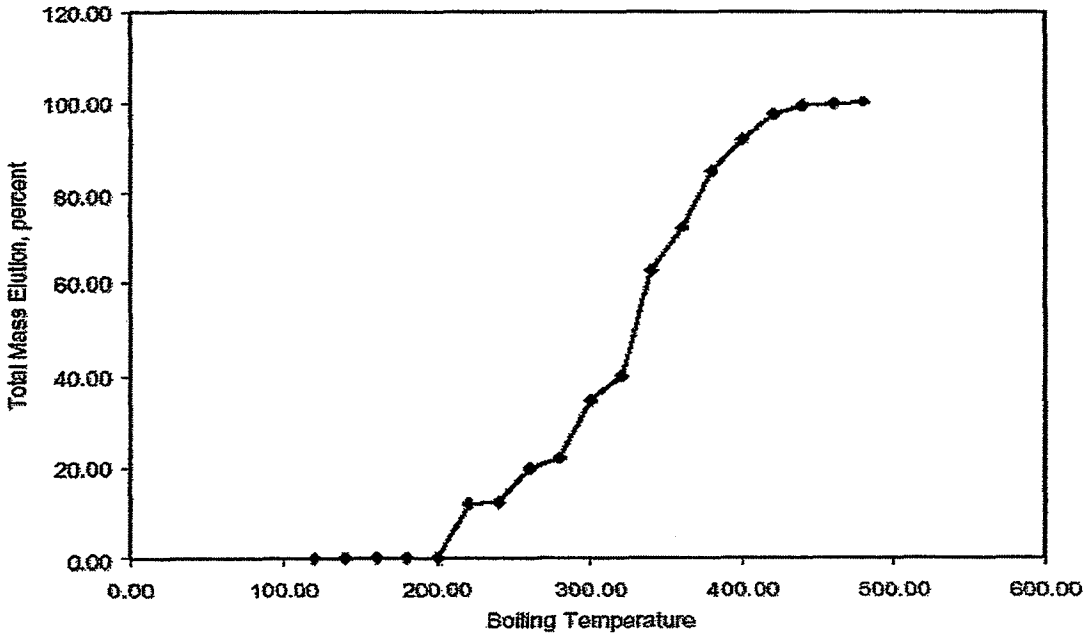
FIG. 2 illustrates a simulated distillation of coal tar distillate based upon data acquired by gas chromatograph.

Reference will now be made in detail to embodiments of the disclosure, examples of which are illustrated in the accompanying drawings. It is to be understood that other embodiments may be utilized and structural and functional changes may be made without departing from the respective scope of the disclosure.

In one embodiment, the disclosure described herein involves the creation of a supply of blended depolymerizating medium, creating a mixture of depolymerizing medium and crushed coal, liberating low boiling point liquids from said mixture, then heating the mixture to devolatilize the coal and depolymerizing medium to create a hot liquid suitable for centrifugation; removing ash via centrifugation; and distilling the ash-free hot liquid resulting in a liquid fraction as well as a pitch. The depolymerizing medium may be a hydrocarbon liquid with a ratio of moisture-free hydrogen-to-carbon content of at least 7.0 percent by mass, and aromaticity (percentage of the liquid that consists of aromatic rings of carbon and hydrogen, with delocalized electrons) of at least 10%, and may be a blend of liquids. One component of the blended depolymerizing medium may be a heavy aromatic oil derived from fossil fuel. One acceptable example is coal tar distillate, such as obtained from a coke battery oven. Other examples of heavy aromatic oil include decant oil from petroleum refining, or other aromatic oils from petroleum refining having 7.0% hydrogen-to-carbon ratio and aromaticity of 10% or higher. Tars from pyrolysis of biomass, sewage, or other hydrocarbons may also be useful in such a blend. The components of the heavy oil may advantageously have a boiling temperature in the range of 200° C. to 450° C. and at least ten percent aromaticity. Lower boiling point liquids such as moisture (water) may also be present, but may comprise less than 5.0% of the blended depolymerizating medium to avoid the possibility of the system pressure increasing when they are heated to 400° C. in a digestion reactor.

Another desired component in the blended depolymerizating medium may be a bio-liquid, or bio-oil, with hydrogen content greater than about 7.0% by mass, and preferably greater than 10% by mass. One purpose of the bio-liquid may be to increase the fluidity of the depolymerizating medium. A second function of the bio-liquid may be to increase the solubility of coal particles in the blended depolymerizing medium. A third function of the bio-liquid may be to provide additional feedstock for conversion to fuels, pitches and other products. A fourth function of the bio-liquid may be to provide greater aliphaticity in the liquid product. An example of the bio-liquid may be biodiesel, biogasoline, soybean oil, other non-hydrogenated vegetable oils, an oil created from vegetable matter with a hydrogen content exceeding 7%, hydrogenated vegetable oils, algae derived bio-oil, alcohols, pyrolysis tars from biomass charring or from biomass coking, lignin or other biological source having high content of hydrocarbons and low concentration of ash producing material.

Optionally, coal may be dried by heating it to above 100° C. at ambient pressure. This is especially desirable for low rank coals having moisture content higher than 5.0 percent. This can be accomplished in an oil bath. Further, optional heating of the depolymerizing medium to less than about 240° C. at atmospheric pressure or lower may be employed, which can liberate lighter molecules including, for example, naphthalene. A cooled condenser may be used to collect these lighter liquids.

Naphthalene and other liquids with a boiling point below 240° C. can serve as feedstocks for chemicals such as tetralin, decalin, or methylnaphthalene, which can be suitable for light fuels and jet fuels. Another reason for separating naphthalene prior to coal digestion is that the digestion process may cause naphthalene to decompose. Naphthalene may decompose due to reactions of the type described by Onwudili and Williams [2007]. Thus, it might not be possible to obtain all of said naphthalene downstream in the process if it is chemically altered in the digestion process.

The blended depolymerizing medium may be combined with coal and heated to between 385° C. and 430° C. in an embodiment, or between 300° C. and 500° C. in other embodiments, for up to one hour in a tank reactor or flowing pipe reactor in order to depolymerize the coal, creating a liquid coal digest. As described herein, this temperature may be sufficient to degrade or depolymerize other chemicals including naphthalene and for that reason a partial distillation may be desirable prior to the digestion process. In embodiments, the depolymerizing medium may have an H/C ratio of less than 0.70, and the coal may be selected such that its H/C ratio is greater than 0.75, thus resulting in an overall digest with H/C ratio greater than 0.70 on an ash-free basis. In embodiments, the bio-oil may not be present, and hydrogenation may not be used to enhance the hydrogen content of the depolymerizing medium.

In an embodiment, deopolymerizing media are not used, and the coal may be selected to have an H/C ratio greater than 0.75, and optimally greater than 0.80, and ash level below 12% by mass, such that the coal can become sufficiently fluid to be centrifuged or filtered directly at a temperature of at least 100° C.

The coal can be bituminous coal, lignite coal or subbituminous coal, or a blend of these coals. Desirable attributes for the coal may include: an ash level of 10% or below, dry basis volatile content of 30% or higher as measured by ASTM Standard D3172-13 or similar standard; and hydrogen to carbon ratio of at least 6.0%, as measured by ASTM Standard D3176. The coal may be crushed to −25 mesh. By maintaining the combination of crushed coal and depolymerizing medium together, a depolymerized coal digest may be created without the apparent transfer of hydrogen from the depolymerizing medium to the coal.

Centrifugation may be employed after creating the liquid coal digest, and allowing the digest to cool to the rated temperature of said centrifuge. Removal of the ash also reduces the tendency of the coal to repolymerize. The centrifuge tails, consisting of ash and additional coal liquids entrained with the ash, represent a separate product stream. For example, the tails can be blended with asphalt or else used as a gasification fuel. Separation may occur at a temperature of about 100° C., or as hot as reasonably achievable in order to reduce the viscosity of the working fluid. The liquid fraction is referred to as a centrate.

The centrate may be distilled into two or more fractions, to create at least a heavy hydrocarbon product as well as liberated volatiles with lower molecular weight, depending on the temperature and pressure of the distillation step. ASTM Standard D 189, Conradson Carbon Yield, is often used to predict and characterize the yield of pitch. Binder Grade Pitch requires a softening temperature of about 110° C. as measured by ASTM D 450, and H/C ratio of about 4.6%. Optionally, heating to 600° C. or higher temperatures can result in removal of virtually all volatiles, resulting in a coke and maximum liquid yield. Conversely, lower temperature distillation results in a lower softening temperature substance and lower yield of liquid.

The condensed liquid products contain many chemicals present in the digested coal, and for that reason these liquid products may be useful as a coal depolymerizing medium. The phrase "depolymerizing medium" refers to a liquid suitable for not only dissolving soluble molecular species, but which also breaks down large molecules. Distillate from approximately 250° C. to 400° C. atmospheric boiling point can be blended with other heavy oils to create additional depolymerizing medium suitable for dissolving and digesting coal. Lighter liquids having H/C ratio higher than 6.8% are useful for increasing the yield of liquid products and decreasing the yield of pitch products. Alternatively distillate liquids may be part of a different product stream.

Another method for reducing the yield of pitch and increasing the yield of liquid products is to select coals with H/C mass ratio of 6.8% or higher, and ash below 6% by mass. Such coals are often associated with high volatile content and high fluidity.

Figure 3:
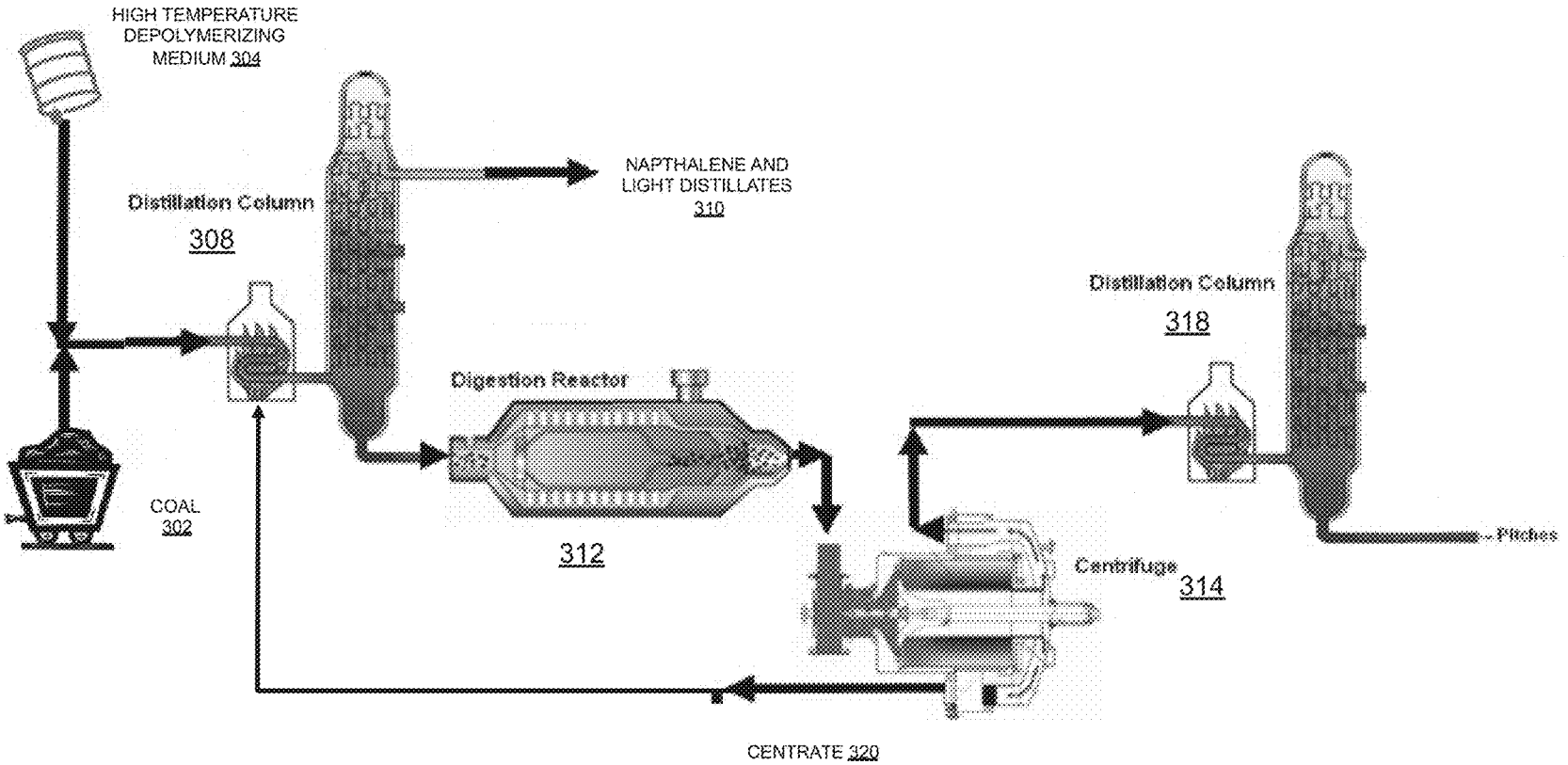
FIG. 3 depicts a system for depolymerizing coal.

In an embodiment of the disclosure, and referring to FIG. 3, one part of crushed coal 302, such as a non-coking lignite coal, is combined with a depolymerizing medium 304 consisting of about two parts of coal tar distillate and optionally about 0.15 parts bio-oil such as soybean oil, lignin or other liquid or oil from vegetable matter with a hydrogen content of at least seven percent by mass. An optional step is to boil the mixture of crushed coal and depolymerizing medium, such as in a distillation column 308 or other appropriate apparatus, at a temperature of at least 200° C. in order to liberate naphthalene 310 and related molecules such as light distillates, which are then separately condensed. Following this step, the mixture of said crushed coal and said depolymerizing medium is heated under pressure to a temperature above 385° C. and lower than 425° C. for a period of at least one minute in a digestion reactor 312 or other appropriate apparatus. This may be sufficient to cause substantial intermingling of the mainly aromatic molecules of the depolymerizing medium and the molecules of the lignite, which have a lower concentration of aromatic molecules. In addition, nitrogen-containing molecules of the non-coking coal are diluted by the depolymerizing medium. Depending on the desired level of mineral matter impurities (ash), the resultant solution or slurry may be optionally centrifuged in a centrifuge 314 or filtered to remove insoluble mineral matter. The depolymerizing medium and dissolved lignite coal may then be distilled in a distillation column 318. The residue is a pitch with increased aromatic content and reduced nitrogen content compared to the original undissolved lignite. High aromatic content and lower nitrogen content are known to be characteristics of a good binder for carbon. The pitch can optionally be further heated to above 450° C. and ideally to above 1100° C. to produce a coke such as metallurgical grade coke. Low ash commercial grade cokes such as foundry grade coke or anode grade coke may also be created if ash is removed via centrifugation from the reacted solution or slurry. Pure lignite pitch normally does not form a strong coke, but the reconstituted lignite pitch has enhanced aromatic content and for that reason produces a strong coke. In embodiments, the centrate 320, either wholly or after being separated into different fractions, may be used as the depolymerizing medium 304.

If centrifugation is not accomplished, the resultant pitch may contain mineral matter (ash) at a level comparable to that level in the original coal, rendering it unsuitable for binder grade pitch, but possibly useful for creating other carbon composites such as synthetic metallurgical grade coke or synthetic foundry grade coke or synthetic injection carbon for metallurgical applications. Additional heating can convert the pitch to coke. Other forms of furnace grade carbon can be produced from coke via standard processes such as heat treatment crushing to appropriate size such as injection carbon, charge carbon or recarburizer carbon.

While only a few embodiments of the present disclosure have been shown and described, it will be obvious to those skilled in the art that many changes and modifications may be made thereunto without departing from the spirit and scope of the present disclosure as described in the following claims. All patent applications and patents, both foreign and domestic, and all other publications referenced herein are incorporated herein in their entireties to the full extent permitted by law.

While the disclosure has been disclosed in connection with the preferred embodiments shown and described in detail, various modifications and improvements thereon will become readily apparent to those skilled in the art. Accordingly, the spirit and scope of the present disclosure is not to be limited by the foregoing examples, but is to be understood in the broadest sense allowable by law.

The use of the terms "a" and "an" and "the" and similar referents in the context of describing the disclosure (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

While the foregoing written description enables one of ordinary skill to make and use what is considered presently to be the best mode thereof, those of ordinary skill will understand and appreciate the existence of variations, combinations, and equivalents of the specific embodiment, method, and examples herein. The disclosure should therefore not be limited by the above described embodiment, method, and examples, but by all embodiments and methods within the scope and spirit of the disclosure.

All documents referenced herein are hereby incorporated by reference.

The invention claimed is:

1. A method of depolymerizing coal, comprising:

providing a high temperature depolymerizing medium comprising heavy hydrocarbon oils;

mixing the high temperature depolymerizing medium with coal to form a mixture, wherein the high temperature depolymerizing medium is a heavy hydrocarbon with H/C ratio higher than 0.070;

performing a first distillation of the mixture to recover naphthalene;

following the first distillation, heating the mixture to create a digested coal slurry; and centrifuging the slurry to produce a centrate liquid, wherein the high temperature depolymerizing medium further comprises an oil, with H/C ratio higher than 0.100, chosen from the group consisting of: soybean oil, pine tar, aromatic petroleum distillate, biomass gasification tar, biomass pyrolysis tar, and oils where the overall hydrogen-to-carbon mass ratio in a digestion reactor is over 0.070 for the mixture of the high temperature depolymerizing medium and the coal.

2. The method of claim 1, wherein the high temperature depolymerizing medium further comprises liquids chosen from the group consisting of: coal tar distillate, decant oil, anthracene oil, and heavy aromatic oils.

3. The method of claim 1, wherein the coal is dried via air drying or heating to above 100° C. prior to exposing the coal to the depolymerizing medium.

4. The method of claim 1, in which the centrate liquid is used as the depolymerizing medium in subsequent executions of the method.

5. The method of claim 1, wherein the mixture comprises a ratio of 1 part coal to a range of at least 1.5 parts to 2.5 parts of depolymerizing medium.

6. The method of claim 1, wherein centrifuging is done at a temperature of at least 100° C., or above the softening temperature of the liquid constituents of the coal digest.

7. The method of claim 1, wherein the coal is a low rank non-coking coal with ash below 5% by mass, the method further comprising distilling the centrate liquid formed from the mixture of the low rank non-coking coal to produce a pitch.

8. The method of claim 1, wherein the coal is selected such that it has less than 6.0% ash.

9. The method of claim 1, further comprising, distilling the centrate liquid to separate it into different fractions according to boiling point.

10. The method of claim 1, wherein said solid carbon coke is selected from the group consisting of: a metallurgical grade coke, a foundry grade coke, and a feedstock for other furnace grade carbon.

11. The method of claim 1, further comprising, prior to centrifuging, filtering the digested coal slurry, so that the produced a centrate liquid has an ash content less than 0.5% by mass.

12. The method of claim 11, wherein the ash content is less than 0.2% by mass.

13. The method of claim 1, wherein the high temperature depolymerizing medium further comprises an oil selected from the group consisting of: a biomass-derived oil, a lignin, a petroleum oil, a pyrolysis oil, and an oil from vegetable matter.

14. The method of claim 1, further comprising, distilling the centrate liquid to produce a pitch residue with hydrogen content between 4.0% and 5.0%, and with a softening temperature of about 110° C. and ash level less than 0.5% by mass.

15. The method of claim 1, wherein heating the mixture is to a temperature of at least 350° C. to create the digested coal slurry.

16. The method of claim 1, wherein the centrate liquid has an ash content of less than 0.5% by mass.

17. A method of depolymerizing coal, comprising:

providing a high temperature depolymerizing medium comprising heavy hydrocarbon oils;

mixing the high temperature depolymerizing medium with coal to form a mixture, wherein the high temperature depolymerizing medium is a heavy hydrocarbon with an H/C ratio higher than 0.070 and the coal is a low rank non-coking coal with ash below 5% by mass;

performing a first distillation of the mixture to recover naphthalene;

following the first distillation, heating the mixture to create a digested coal slurry;

centrifuging the slurry to produce a centrate liquid;

distilling the centrate liquid to produce a pitch; and converting the pitch to a solid carbon coke, in an oxygen-depleted environment at above 600° C., and co-producing thermally liberated volatile molecules.

18. A method of depolymerizing coal, comprising:

providing a high temperature depolymerizing medium comprising heavy hydrocarbon oils;

mixing the high temperature depolymerizing medium with coal to form a mixture, wherein the high temperature depolymerizing medium is a heavy hydrocarbon with an H/C ratio higher than 0.070 and less than 0.70, and the coal is selected such that its H/C ratio is greater than 0.75, wherein the mixture of the high temperature depolymerizing medium and the coal has an overall H/C ratio greater than 0.70 on an ash-free basis;

performing a first distillation of the mixture to recover naphthalene;

following the first distillation, heating the mixture to create a digested coal slurry; and centrifuging the slurry to produce a centrate liquid.

19. The method of claim 18, wherein a bio-oil is not present, and hydrogenation is not used to enhance the hydrogen content of the depolymerizing medium.

* * * * *